United States Patent [19]

Bodet

[11] 3,996,736

[45] Dec. 14, 1976

[54] CLOCK OR CALENDAR WITH REMOVABLE CASING

[76] Inventor: Marie-Therese Bodet, La Marzello, 1 rue de l'Evre, 49 340 Trementines, France

[22] Filed: Aug. 25, 1975

[21] Appl. No.: 607,617

[30] Foreign Application Priority Data

Sept. 13, 1974 France ..... 74.31014

[52] U.S. Cl. ..... 58/53; 58/54; 58/56; 58/127 R

[51] Int. Cl.[2] ..... G04B 37/00

[58] Field of Search ..... 58/53, 56, 54, 55; D10/1, 2, 40, 41; 174/66, 52 R; 40/107, 118, 120, 65.6; 248/114–116

[56] References Cited

UNITED STATES PATENTS

| | | | |
|---|---|---|---|
| 2,253,715 | 8/1941 | Lux | 58/127 R X |
| 2,558,518 | 6/1951 | Heymann | 58/54 |
| 2,638,735 | 5/1953 | Schlenker | 58/127 R X |
| 2,838,905 | 6/1958 | Marble | 58/54 |
| 3,837,160 | 9/1974 | Hettich | 58/55 X |
| 3,905,189 | 9/1975 | Siefert et al. | 58/56 |

*Primary Examiner*—Ulysses Weldon
*Attorney, Agent, or Firm*—Young & Thompson

[57] ABSTRACT

Apparatus for indicating the passage of time, which may be a clock or a calendar, comprising a base that is mounted on a wall and operating mechanism that is mounted on the forward side of the base. A removable cover comprises a transparent front plate surrounded by a frame, which frame in turn surrounds and is releasably secured to a forwardly extending flange that surrounds the base plate. Bosses on the upper inner side of the rear edge of the frame engage in upwardly opening recesses on the top of the base flange; while interengageable hooks at the bottom of the frame and base flange releasably retain the cover on the base. One of these hooks is manually disengageable from the other by pressing on a spring-urged button.

6 Claims, 4 Drawing Figures

CLOCK OR CALENDAR WITH REMOVABLE CASING

The present invention relates to clocks and/or automatic calendars, particularly but not exclusively those of the type of the flip card type.

In known timepieces with batteries and hands, the mechanism is fixed to the rear of a plate whose forward face comprises the dial. The mechanism and plate are inseparable and the purchaser must buy them together, mount them on the wall and take them down, as a unit, without the possibility of changing the plate if he desires. Moreover, it is difficult to gain access to the mechanism, for example for changing the battery, from the front; and it is necessary to take the clock down to perform even the least operation on it.

These drawbacks, or drawbacks of the same magnitude, are also found in more elaborate devices, for example clocks and/or calendars of the flip card type. In this case, the apparatus is contained in a special casing, that is, a box closed in front by a cover, the whole being ordinarily attached to a wall. It is difficult to gain access to the mechanism, and sometimes the control devices extend outside the casing to permit the user to reset the clock to the right time and/or the calendar to the right date, but this arrangement has certain technical complications and is unsightly. As in the case of a simple clock, the casing assembly must be chosen once for all time at the time of purchase, and therefore, for a given clockwork, it is not possible to choose another casing, and particularly not easy to change the same in the future. More precisely, it is not possible for the user himself to change the casing, nor even to change the cover, for example when he moves or when he redecorates.

The invention overcomes these drawbacks and has for its object the provision of a clock or automatic calendar or both, or other similar apparatus constituted by a mechanism housed in a casing, the said mechanism being fixed to a flat base, which has a narrow flange enclosing the rear of the casing, the base itself being fixed to the wall and closed by a cover, characterized in that the cover has the general form of a casing having its front wall transparent with a large continuous flange, the casing being such as to cap and surround the assembly of the mechanism and the circumference of the base, or the flange of the base when it has one, said cover being provided with means to insure its securement on the base which is itself provided with complementary means to permit the easy attachment or removal of said cover, which cover serves for protection and decoration and may be removed completely by a single operation in a simple manner and with no tools, thereby giving access to the mechanism for any desired operation such as setting or regulating the clock, and this without unfastening the base of the casing, and thus the assembly, from the wall. Removal and replacement of the cover can be effectuated without the aid of a tool.

The cover is constituted by a transparent forward wall or plate that may be flat or preferably convex or contoured, and a lateral wall or frame which is colored in which the forward plate is mounted, this lateral frame being comprised by a skirt which is substantially rearwardly divergent, whose free edge is provided with means for attachment to the base. The frame comprises internally on the one hand these means for attachment on the base and on the other hand means to retain the transparent face plate and perhaps other plates in such a manner that the assembly of the cover may be removed in a single operation and that it will thereafter be possible to change the plate or the frame of the cover.

Means for securing the cover on the base are comprised by at least a securement finger cooperating with a snap detent, one of these two members being formed on the base and the other on the cover.

In the case of a flip card apparatus, the cover is provided behind its transparent face with an opaque plate which is provided with windows that expose only those parts of the mechanism mounted on the base, which are to be read. This latter plate is fixed in the cover by the same means as the transparent plate, the frame comprising a flange against which the plate or plates are retained by a series of small abutments provided at an appropriate distance behind the inside border of the frame.

According to the invention, the characteristics of the apparatus also permit modification of its shape by simply changing the cover without changing nor even moving the rest of the device. When the frame of the cover is colored, replacing one cover with another cover whose frame is a different color will change the color of the device. It is also possible to provide different external shapes of covers to modify the configuration of the clock. Thus upon redecorating the room in which the clock is used, it is possible to change the color and/or shape of the clock to coordinate with the new color and/or style. It is very simple to change the cover, but it is equally easy to disassemble the cover into its elemments, and it is possible to reassemble the cover with another frame of the same internal size but of a color and/or external shape which is different.

All the covers are interchangeable on the base of the casing with the latter remaining fixed to the wall.

Whatever the color or external shape of the cover, it will be understood that the decorative aspects of the present invention do not mitigate against the protective function of the cover nor the ease of access to the mechanism from the front or the side when the cover is removed.

This latter aspect of the present invention is particularly important in the case of flip card clocks or calendars. Because no control member passes through the casing, which is to say the cover according to the invention, the cover is simple to construct, which lowers its cost and facilitates its changing.

The invention will be better understood with reference to the accompanying drawings, in which.

Figure 1:
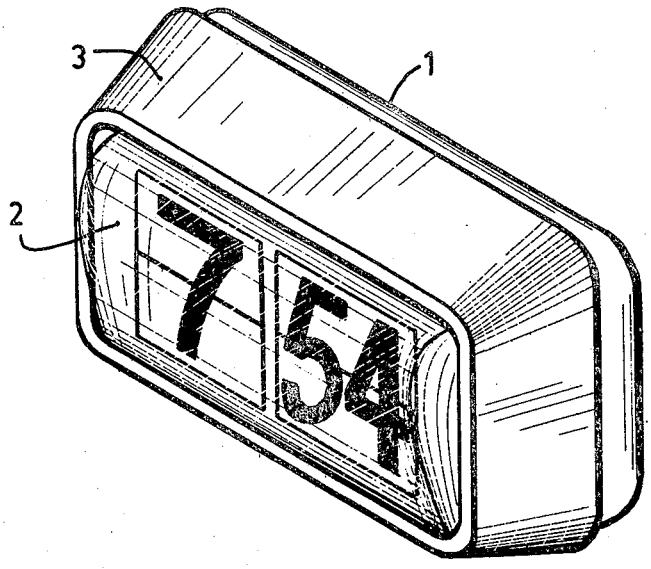
FIG. 1 is a perspective view of a flip card clock according to the present invention.

Referring now to the drawings in greater detail, there is shown a clock according to the present invention comprised by a base 1, clockwork 2 and a cover 3. For greater clarity, the details of the clockwork 2 are not shown, nor its mode of securement to the base 1, but these are entirely conventional.

Base 1 is constituted by a plate 4 whose edges 5 are bent forwardly, having the overall shape of a cup. Externally, a hook 7 is provided for suspending the clock, and the upper parts of the edges 5 have two recesses 6, 6' (see in FIGS. 2 and 3), which open outwardly, that is, upwardly, whose purpose will be explained later. On the lower internal portion of the edge 5 is secured a catch 8 of known type, mounted on a button 24 which is accessible from outside the casing, thereby permitting manipulation of a hook 23 by pushing on the button 24. The latter returns to its original position when released, thanks to a coil compression spring (seen in FIG. 4).

On the base 1 is mounted the cover 3 comprising a transparent convex front plate 9 of glass or transparent plastic, a mask 10 with openings 11 and 12 therethrough, and a frame 13.

Figure 2:
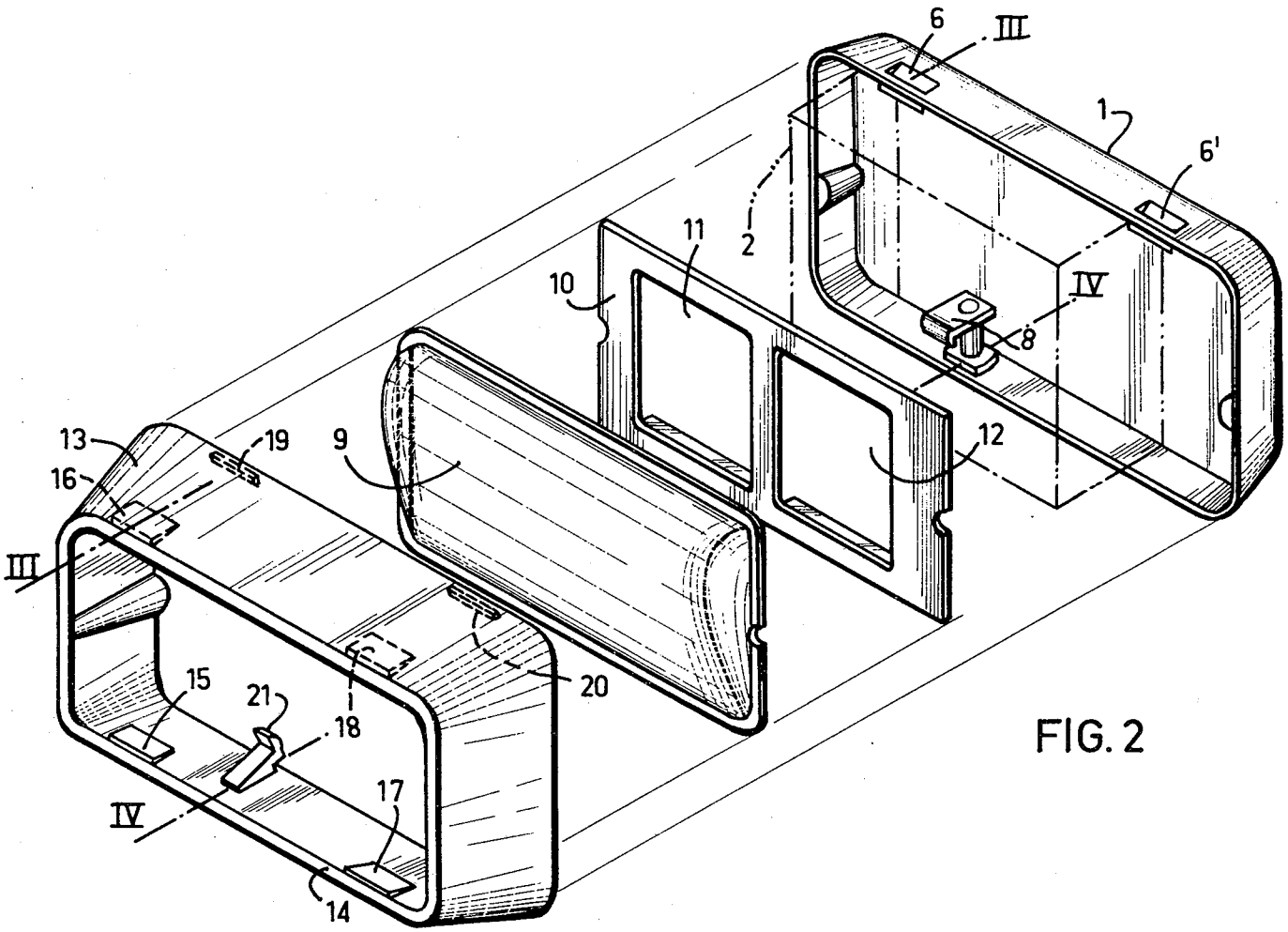
FIG. 2 is an exploded perspective view of the clock of FIG. 1.

The form of the frame 13 is seen in the different figures. It comprises a narrow flange 14 which however is sufficient to retain the plate 9 about the edges thereof. Inside the frame are provided abutments 15–18 spaced from flange 14 so as to receive between the flange 14 and the abutments the plate 9 and mask 10. Also within frame 13, but only on the upper part thereof, are provided two small longitudinal bosses 19 and 20 that fit into the recesses 6 and 6', respectively. On the lower part of the frame, there is an inwardly extending finger 21 with an end hook 22, as seen in FIGS. 2 and 4.

Figure 3:
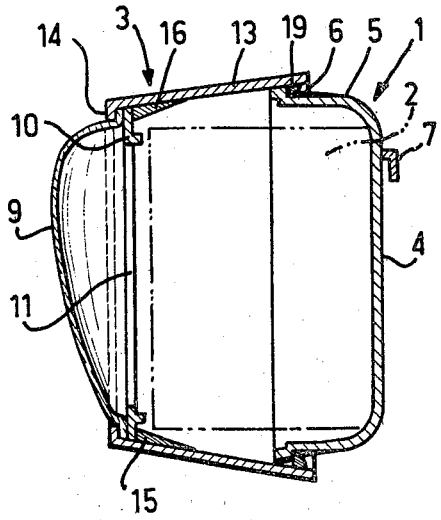
FIG. 3 is a cross-sectional view on the line III—III of FIG. 2.

To assemble the cover 3, the plate 9 and the mask 10 are inserted in the frame 13, these elements being sufficiently resilient that the plate and mask can snap-in between the abutments 15–18 and the flange 14, as seen in FIG. 3.

Figure 4:
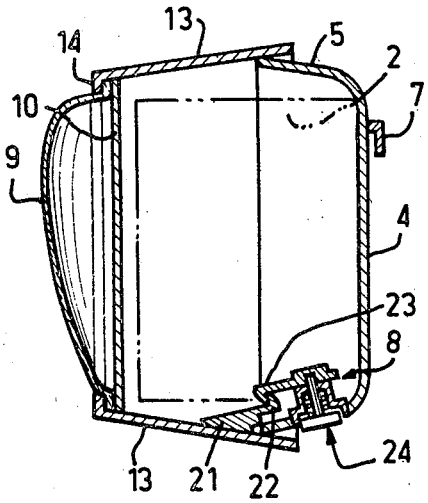
FIG. 4 is a cross-sectional view on the line IV—IV of FIG. 2.

To mount the assembled cover 3 on the base 1, the bosses 19 and 20 are lodged in the recesses 6 and 6', and then the lower part of the cover 3 and the base 1 are swung together and pressed until the hook 22 of the finger 21 slightly raises the hook 23 of the catch 8 against the effect of the coil compression spring that urges the button 24 downwardly, until the hooks 22 and 23 snap together into the position shown in FIG. 4.

To remove the cover 3 from the base 1, one presses on the button 24 to raise the hook 23, and then the bottom of the cover 3 can be pulled forwardly by the frame 13 until the finger 21 entirely escapes the catch 8, whereupon the cover can be lifted off the base 1 entirely.

Access to the clockwork is thus afforded from the front of the clock and on all sides thereof, without moving the clockwork and without even removing the clock from the wall. Moreover, as it is quite easy to mount and demount the cover from the base, and as the frame 13 covers all visible sides of the clock, it is an easy matter to replace this frame by a frame of a different color, merely by replacing the entire cover, so that the appearance of the clock can be changed to conform to the decoration of the room in which it is located.

In the illustrated embodiment, the clock shown is of the flip card type, but it is of course to be understood that the invention may be applied to other devices, particularly automatic calendars of the flip card type, and even also to clocks with hands, as well as combined clock-calendars. All such devices are generically referred to hereinafter as apparatus for indicating the passage of time.

From a consideration of the foregoing disclosure, therefore, it will be evident that the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. Apparatus for indicating the passage of time, comprising a base, means for mounting the base on a wall, mechanism for operating a time change display, said mechanism being carried by said base on the side of said base opposite said wall, a cup-shaped cover enclosing said mechanism, said cover having a transparent front plate and a frame surrounding said front plate and said base, means releasably securing the rear edge of said frame to said base, and an opaque mask carried by said frame behind said transparent plate, said mask having openings therethrough for the display of time indicia.

2. Apparatus as claimed in claim 1, said transparent plate and said mask being retained between a forward flange of said frame and a plurality of abutments on the interior of the frame that are spaced rearwardly of said flange.

3. Apparatus as claimed in claim 1, there being a catch between the cover and the base for securing the cover removably on the base.

4. Apparatus as claimed in claim 1, said releasable means being comprised by said base having a forwardly extending flange about its edges, said base flange having means cooperating with the rear edge of said frame releasably to retain said cover on said base.

5. Apparatus as claimed in claim 4, the upper portion of said base flange having recesses therein in which bosses formed on the inner underside of an upper portion of said frame engage, and a manually operated catch between the bottom of said frame and the bottom of said base flange.

6. Apparatus as claimed in claim 5, said catch comprising interengaging hooks on said base flange and said frame, and means to move one of said hooks out of engagement with the other of said hooks.

* * * * *